United States Patent [19]

Hyner et al.

[11] 4,143,210

[45] Mar. 6, 1979

[54] MULTI-LAYER PLATING FOR IMPROVED CORROSION RESISTANCE

[75] Inventors: Jacob Hyner, Waterbury; Stephen Gradowski, Torrington, both of Conn.

[73] Assignee: Whyco Chromium Company, Inc., Thomaston, Conn.

[21] Appl. No.: 838,241

[22] Filed: Sep. 30, 1977

[51] Int. Cl.[2] ..... B32B 15/18

[52] U.S. Cl. ..... 428/646; 428/648; 428/657; 428/659; 428/666; 428/668

[58] Field of Search ..... 209/40; 428/935, 648, 428/646, 657, 668, 659, 666

[56] References Cited

U.S. PATENT DOCUMENTS

| | | | |
|---|---|---|---|
| 1,615,707 | 1/1927 | Jones et al. | 428/935 |
| 3,011,957 | 12/1961 | Elgenmann | 204/40 |
| 3,245,577 | 4/1966 | Virzi | 428/646 |
| 3,323,881 | 6/1967 | Nelson et al. | 428/935 |
| 3,816,082 | 6/1974 | Austin et al. | 428/659 |
| 3,857,684 | 12/1974 | Kubu | 428/935 |
| 3,997,301 | 12/1976 | Yoshihara et al. | 428/648 |
| 4,029,556 | 6/1977 | Monaco et al. | 204/40 |

OTHER PUBLICATIONS

"Electroplating Engineering Handbook", Graham, 1955, pp. 366–376.

*Primary Examiner*—Arthur J. Steiner
*Attorney, Agent, or Firm*—DeLio and Montgomery

[57] ABSTRACT

A multi-layer plating and method are provided for improved corrosion resistance of ferrous metal substrates and articles made therefrom. The multi-layer plating comprises a metallic coating comprising a layer of zinc or cadmium and a layer of tin, each of which are preferably between 0.00001 to 0.001 inches in thickness, followed by a layer, preferably between about 0.0001 to 0.000001 inches in thickness of either chromium or a metallic chromium substitute. The method comprises plating, and preferably electroplating, the aforementioned layers of metal over an article having ferrous metal base stock to obtain improved corrosion resistance.

9 Claims, No Drawings

MULTI-LAYER PLATING FOR IMPROVED CORROSION RESISTANCE

BACKGROUND OF THE INVENTION

The present invention pertains to the field of metal plating, and more specifically, to a method and multi-layer plating for improved corrosion resistance of articles having a ferrous metal substrate which provides satisfactory appearance for commercial utilization, perferably as either bright or dull chromium or chromium-substitute finished articles.

While various attempts have been made in the metal plating industry to develop chromium finished articles, or articles having the appearance of a chromium finish, from ferrous metal base stock which have suitable corrosion resistance to allow usage in corrosive environments, it has been discovered that the novel method and multi-layer plating of the present invention provides superior performance.

It has been known that ferrous metal articles could be plated with zinc or cadmium, followed by a layer of tin, in order to obtain a certain degree of corrosion resistance. U.S. Pat. No. 1,615,707 to Jones et al. is directed to such a plating sequence. However, there is no teaching or suggestion of combinations with a further layer of chromium or a chromium-substitute, as has been discovered can be advantageously utilized in accordance with the present invention. U.S. Pat. No. 3,011,957 to Eigemann likewise utilizes sequential platings of cadmium or zinc and tin, but such are indicated as being provided over a ferrous metal substrate which is first subjected to a phosphatizing treatment, in order to obtain improved corrosion resistance. Likewise, U.S. Pat. No. 3,011,957 sets forth no teaching or suggestion that a final layer of chromium or a chromium substitute could be advantageously utilized in combination with layers of zinc or cadmium or tin, as has been discovered in accordance with the present invention.

U.S. Pat. No. 3,997,301 to Yoshihara also indicates that sequentially plated layers of tin and zinc can be used over a low-carbon steel substrate. Yoshihara et al. further indicate that an optional film consisting of a hydrate of chromium oxide may optionally be superimposed over the zinc layer, in order to obtain improved corrosion resistance. However, Yoshihara et al., while disclosing that a hydrate of chromium oxide could be utilized, do not indicate or suggest that a layer of metallic chromium or a metallic chromium substitute could be used in such a combination for the top layer, as has been discovered in accordance with the present invention.

Thus, in view of the present state of the art, the novel combination of cadmium or zinc, tin and chromium or a metallic chromium substitute in accordance with the present invention has not previously been known or suggested. Consequently, the beneficial and advantageous results with regard to improved corrosion resistance which are provided in accordance with the present invention have not heretofore been known or available for use in the industry.

SUMMARY OF THE INVENTION

In accordance with the present invention, a multi-layer metallic plating for providing improved corrosion resistance on ferrous metal substrates is provided comprising a layer of zinc or cadmium plated over the ferrous metal substrate, a layer of tin, plated over the layer of zinc or cadmium, and a final layer of chromium or a metallic chromium substitute. Preferably, the thickness of the first and second layers, respectively, ranges between 0.00001 to 0.001 inches, while the thickness of the third layer of chromium or metallic chromium substitute ranges between 0.000001 to 0.0001 inches. Likewise, the present invention provides articles having a chrome or chrome-like finish which are made from ferrous metal base stock and which have improved corrosion resistance. These articles comprise a layer of zinc or cadmium plated over the ferrous metal base stock and a layer of tin plated over the zinc or cadmium layer, followed by a layer of chromium or a metallic chromium substitute to provide either a bright or dull top finish, as may be desired.

Furthermore, a method is provided for improving the corrosion resistance of an article made of a ferrous metal base stock which comprises sequentially plating a first layer of zinc or cadmium, a second layer of tin and a third layer of chromium or a metallic chromium substitute having the ranges of thickness indicated hereinabove. Furthermore, in accordance with the method of the invention, the sequence of these first and second layers can be reversed, while still providing substantially improved corrosion resistance.

It is a primary object of the present invention to provide a novel multi-layer plating which provides improved corrosion resistance to a ferrous metal substrate.

It is also a primary object of the invention to provide a useful and novel method for imparting superior corrosion resistance to a ferrous metal substrate, so as to provide a chromium or chromium-like finish which is of an acceptable commercial quality, both for bright or dull finish appearance.

It is yet a further object of the invention to provide chrome-finished articles having improved corrosion resistance, while maintaining a commercially acceptable appearance, either of a bright or dull-type chromium or chromium-like finish.

It is still a further object of the invention to provide a novel multi-layer plating and method for providing improved corrosion resistance utilizing a novel combination of plated metal layers obtained from conventional plating baths and applied over conventional untreated ferrous metal substrates.

Other objects and advantages of the multi-layer plating and method of the invention will be readily apparent to those skilled in the art through the study of the following description of the preferred embodiments and the appended claims.

DETAILED DESCRIPTION

The metal substrate, or base metal stock, upon which the novel multi-layer plating is provided and to which the novel method of the present invention is applied is a ferrous metal, or an alloy thereof. For example, iron or various types of steel may preferably be utilized. It is fully within the purview of the invention, that the type of ferrous metal, or the form in which it is provided for treatment in accordance with the present invention, is not limited. While no special treatment of the ferrous metal surface is required in accordance with the present invention, it is further within the purview thereof that any treatment of the ferrous metal surface may also be utilized in conjunction with the present invention, provided that such treatment does not prevent or interfer with subsequent plating of either zinc, cadmium or tin directly thereover.

In accordance with the invention, a multi-layer metallic plating is provided by plating, and preferably electroplating, a layer of metal which may either be zinc or cadmium. This layer of metal is plated directly on the ferrous metal substrate, or ferrous metal base stock of an article to be treated or prepared in accordance with the invention.

A layer of tin is then plated, and preferably it is electroplated, over the layer of zinc or cadmium. It is, however, fully within the purview of the present invention that the sequence of plating the aforementioned layer of zinc or cadmium and the layer of tin, may be reversed, so that the layer of tin is plated directly on the ferrous metal substrate, and the layer of zinc or cadmium is plated over that layer of tin. It has been found that while it is preferred to use zinc or cadmium as the first layer and tin as the second layer, the improved corrosion resistance which can be achieved in accordance with the invention can also be obtained by reversing the sequence of these two layers of metal.

Irrespective of the sequence of plating the layer of zinc or cadmium, and the layer of tin, it is preferred that the thickness of each of these layers, respectively, should range between about 0.00001 to 0.001 inches.

Finally, a layer of chromium and/or metallic chromium substitute is plated, and again preferably it it electroplated, over the second layer. This layer preferably should range between about 0.000001 to 0.0001 inches in thickness.

It has been found that use of a layer of less thickness than preferably indicated for each of the respective metals results in failure to achieve the full improvement in corrosion resistance which is possible in accordance with the invention. Nevertheless, it is within the purview of the invention that a thinner layer can be utilized, although the superior corrosion resistance otherwise possible in accordance with the preferred embodiments of the present invention may not be obtained.

It has also been found that use of a layer of metal having a thickness greater than those indicated above is unnecessary, in order to achieve the improved corrosion resistance properties of the novel multi-layer plating of the invention. Accordingly, it is uneconomical to use a greater thickness than indicated, although it would still be within the purview of the invention that such could nevertheless be done.

The chromium substitutes which may be utilized in accordance with the invention include, but are not limited to, the ternary alloys disclosed and claimed in U.S. Pat. No. Re. 29,239, which is hereby incorporated by reference. These metals and alloys can all be utilized to provide performance qualities, corrosion resistance and/or appearance which may be substituted for chromium. The preferred metallic chromium substitutes are the aforementioned ternary alloys of tin, cobalt and a third metal which is either antimony, zinc or a metal of Periodic Table Group $III_A$ of $VI_B$. These ternary alloys provide superior corrosion resistance and appearance.

These chromium substitutes are applied as metallic layers in place of, or in combination with, chromium as the final layer in the multi-layer plating and method of the invention. As such, these metallic chromium substitutes are applied by conventional techniques, most preferably by electroplating. For example, the preferred ternary alloys may be applied from aqueous plating bath formulations and utilizing electroplating conditions, as disclosed in the aforementioned U.S. Pat. No. Re. 29,239 which is incorporated herein by reference.

It is also within the purview of the invention that other ternary alloys containing substantial portions of tin and cobalt, as well as simple binary alloys of tin and cobalt, may be utilized as chromium substitutes. However, these materials do not provide the superior performance or appearance of the preferred ternary alloys disclosed and claimed in the U.S. Pat. No. Re. 29,239.

Articles which may benefit from application of the multi-layer plating of the invention include, but are not limited to, steel fasteners, screw machine or eyelet parts, stampings or the like of various shapes and sizes. In particular, articles having a chrome finish for automotive use, such as fasteners, bumpers, decorative trim and the like, are beneficially made in accordance with the invention.

In accordance with the present invention articles made from ferrous metal base stock and having improved corrosion resistance can be prepared by providing a plated metallic coating over the ferrous metal substrate comprising a layer of zinc or cadmium and a layer of tin, and thereafter providing a plated layer of chromium or metallic chromium substitute over this metallic coating. As indicated hereinabove, the sequence of the layers comprising the plated metallic coating is preferably (1) a layer of zinc or cadmium and (2) a layer of tin, although it is fully within the purview of the invention that the reversed sequence can also be utilized.

Furthermore, in accordance with the invention a method of improving the corrosion resistance of an article having a ferrous metal substrate is provided by sequentially plating, and preferably electroplating, over the ferrous metal substrate, a first layer of zinc or cadmium, a second layer of tin and a third layer of chromium or metallic chromium substitute, the respective layers being within the range of thickness indicated hereinabove. Likewise, as indicated above in accordance with the method of the present invention the sequence of the first and second layers may be reversed.

The layers of zinc or cadmium, tin or chromium or metallic chromium substitute may be plated in any conventional manner, utilizing any conventional plating bath or method for each respective layer of metal. Since it is preferred that each of these plated layers be electroplated, conventional electroplating baths and techniques can be utilized.

For example, the parts to be plated may be made cathodic in any of the following bath formulations, as required to provide the desired metallic layer:

| | |
|---|---|
| Cadmium Bath | |
| Cadmium Oxide | 31.5 g/l |
| Sodium Cyanide | 142.3 g/l |
| Plating Conditions | |
| Temperature | 23.9–32.2° C |
| Current Density | 5–150 amp/ft$^2$ |
| Zinc Bath | |
| Zinc Cyanide | 59.9 g/l |
| Sodium Cyanide | 41.9 g/l |
| Caustic Soda | 78.6 g/l |
| Plating Conditions | |
| Temperature | 23.9–37.80° C |
| Current Density | 3–90 amp/ft$^2$ |
| Tin Bath | |
| Potassium Stannate | 104.9 g/l |
| Potassium Hydroxide | 15.0 g/l |
| Plating Conditions | |
| Temperature | 66–88° C |
| Current Density | 30–400 amp/ft$^2$ |
| Chromiun Bath | |
| Chromic Acid | 299.6 g/l |
| Sulfuric Acid | 3.0 g/l |

-continued

| | |
|---|---|
| Plating Conditions | |
| Temperature | 40–54° C |
| Current Density | 144–432 amp/ft$^2$ |
| Chromium Substitute Bath (Co/Sn/Zn) | |
| Cobalt Chloride | 20–200 g/l |
| Stannous Chloride | 10–100 g/l |
| Ammonium Bifluoride | 20–400 g/l |
| Hydrochloric Acid (37%) | 40–150 ml/l |
| Ammonium Hydroxide (28%) | 10–50 m/l |
| Zinc Chloride | 15–175 g/l |
| Plating Conditions | |
| Temperature | 60–80° C |
| Current Density | 10–30 amp/ft$^2$ |
| pH of Bath | 1–3 |

EXAMPLE 1

In accordance with the method of the invention, a steel fastener was electroplated with sequential layers of zinc, tin and chromium. The zinc layer was electroplated from a conventional zinc electroplating bath containing a source of zinc ions as described in the aforementioned Zinc Bath by application of 10 amp/ft$^2$ at 90° F., using the fastener as the cathode. The tin layer was electroplated from a conventional tin electroplating bath containing a source of tin ions as described in the aforementioned Tin Bath by application of 75 amp/ft$^2$ at 150° F., using the fastener as the cathode. The chromium layer was electroplated from a conventional chromium electroplating bath containing a source of chromium ions as described in the aforementioned Chromium Bath by application of 216 amp/ft$^2$ at 110° F., also using the fastener as the cathode. Each layer of zinc and tin was electroplated to a thickness of about 0.0002 inches, and the layer of chromium was electroplated to a thickness of about 0.00001 inches.

The multi-layer plated steel fastener was then subjected to standard CASS tests for corrosion resistance. The protection against corrosion was found to be in excess of 70 hours.

EXAMPLE 2

As in Example 1, a steel fastener was electroplated with sequential layers of cadmium, tin and chromium to a thickness of 0.0002 inches for each to the respective layers of cadmium and tin and 0.00001 inches chromium. The cadmium layer was electroplated from a conventional cadmium electroplating bath containing a source of cadmium ions as described in the aforementioned Cadmium Bath by application of 30 amp/ft$^2$ at 90° F., also using the fastener as the cathode. Again, standard CASS tests for corrosion resistance were conducted on the plated fastener and protection against corrosion was found to be in excess of 100 hours.

EXAMPLE 3

Several steel test strips were electroplated with the various metallic layers to the thickness indicated in Table 1, below. For comparative purposes, the steel test strips were prepared both with and without the final chromium layer, with the resulting CASS readings indicated. As is readily apparent from Table 1, substantial improvement in corrosion resistance is obtained by the novel combination of a final layer of chromium over layers of zinc or cadmium and tin plating.

Table 1

| Sequence of Layers | | | | | | CASS Corrosion Resistance (HRS.) |
|---|---|---|---|---|---|---|
| 1st Layer | Thickness | 2nd Layer | Thickness | 3rd Layer | Thickness | |
| Cadmium | 0.0001" | Tin | 0.0001" | | | 45 |
| Cadmium | 0.0001" | Tin | 0.0001" | Chromium | 0.00001" | 83 |
| Cadmium | 0.0002" | Tin | 0.0002" | | | 68 |
| Cadmium | 0.0002" | Tin | 0.0002" | Chromium | 0.00001" | 106 |
| Zinc | 0.00015" | Tin | 0.00015" | | | 27 |
| Zinc | 0.00015" | Tin | 0.00015" | Chromium | 0.00001" | |
| Cadmium | 0.0001" | Tin | 0.00035" | | | 52 |
| Cadmium | 0.0001" | Tin | 0.00035" | Chromium | 0.00001" | 85 |
| Zinc | 0.0002" | Tin | 0.0002" | | | 46 |
| Zinc | 0.0002" | Tin | 0.0002 | Chromium | 0.00001" | 70 |

As will be readily apparent to one skilled in the art, various modifications may be made in the details of the method and multi-layer plating of the invention to provide improved corrosion resistance over a ferrous metal substrate and thereby provide a chromium or chromium-like finish article having improved corrosion resistance. As indicated previously, various conventional methods of plating the various metallic compositions for each of the metals utilized as layers of the multi-layer plating may be utilized, including but not limited to electroplating, electroless-plating and other conventional application techniques. Of course, it is fully within the purview of the invention that the form of the ferrous metal substrate or ferrous metal base stock to which the novel multi-layer plating of the invention can be applied may comprise any article of manufacture which can be made therefrom and which will benefit from the superior corrosion resistance provided by the invention.

What is claimed is:

1. A multi-layer metallic plating for providing improved corrosion resistance to a ferrous metal substrate comprising:
   (a) a first layer plated on said substrate selected from the group consisting of zinc and cadmium,
   (b) a second layer of tin plated over said first layer, and
   (c) a third layer selected from the group consisting of chromium and metallic chromium substitute selected from the group consisting of a ternary alloy comprising cobalt, tin and a third metal selected from antimony, zinc or a metal of Periodic Group $III_A$ or $VI_B$, or a binary alloy comprising cobalt and tin, said third layer being plated over said second layer, the thickness of each of said first and second layers, respectively, ranging between 0.00001 to 0.001 inches and the thickness of said third layer ranging between 0.000001 to 0.0001 inches.

2. The multi-layer metallic plating of claim 1 wherein said first layer is zinc.

3. The multi-layer metallic plating of claim 1 wherein said first layer is cadmium.

4. In an article of ferrous metal base stock having a chrome-like finish and improved corrosion resistance, the improvement comprising a metallic coating comprising a layer of metal selected from zinc or cadmium and a layer of tin plated over said ferrous metal base stock, with a layer of metal selected from chromium or metallic chromium substitute selected from the group consisting of a ternary alloy comprising cobalt, tin and a third metal selected from antimony, zinc, or a metal of Periodic Group $III_A$ or $VI_B$, or a binary alloy comprising cobalt and tin, said third layer being plated over said metallic coating, the thickness of each of said layers comprising said metallic coating being between about 0.000001 to 0.001 inches and the thickness of said layer of chromium or metallic chromium substitute being between about 0.0001 to 0.000001 inches.

5. The article of claim 4 wherein each of said layers is an electroplated layer of metal.

6. A plated metal fastener having superior corrosion resistant properties and a chrome-like appearance, comprising a fastener having separate layers including, (a) a structural base metal substrate of ferrous metal, (b) a first layer plated on said substrate selected from the group consisting of zinc and cadmium, (c) a second layer of tin plated over said first layer, and (d) a third layer selected from the group consisting of chromium and metallic chromium substitute selected from the group consisting of a ternary alloy comprising tin, cobalt and a third metal, selected from the group consisting of antimony, zinc or a metal of Periodic Group $III_A$ or $VI_B$, or a binary alloy comprising cobalt and tin, said third layer being plated over said second layer, the thickness of each of said first and second layers, respectively, ranging between 0.00001 to 0.001 inches and the thickness of said third layer ranging between 0.000001 to 0.0001 inches.

7. The plated metal fastener of claim 6 wherein said first layer is zinc.

8. The plated metal fastener of claim 6 wherein said first layer is cadmium.

9. The plated metal fastener of claim 6 wherein said ternary alloy comprises tin, cobalt and zinc.

* * * * *

UNITED STATES PATENT AND TRADEMARK OFFICE

CERTIFICATE OF CORRECTION

PATENT NO. : 4,143,210

DATED : March 6, 1979

INVENTOR(S) : Jacob Hyner et al

It is certified that error appears in the above-identified patent and that said Letters Patent are hereby corrected as shown below:

Column 4, line 61, "37.80°C" should read --37.8°C--

Column 6, line 22, insert --46-- in the last column of the Table

Column 6, line 61, insert --said-- after "and" and before "second"

Signed and Sealed this

*Twenty-fourth* Day of *July 1979*

[SEAL]

*Attest:*

*Attesting Officer*

LUTRELLE F. PARKER

*Acting Commissioner of Patents and Trademarks*